US006681707B2

(12) United States Patent
Michioku et al.

(10) Patent No.: US 6,681,707 B2
(45) Date of Patent: Jan. 27, 2004

(54) SEWING MACHINE HAVING A MEANS FOR SETTING A SEWING WORKING DEVICE TO A PREDETERMINED OPTIMUM SET VALUE

(75) Inventors: Kanji Michioku, Hiroshima (JP); Masao Sato, Hiroshima (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 10/350,842

(22) Filed: Jan. 24, 2003

(65) Prior Publication Data

US 2003/0172861 A1 Sep. 18, 2003

(30) Foreign Application Priority Data

Jan. 25, 2002 (JP) ..... 2002-017102

(51) Int. Cl.[7] ..... D05B 19/12
(52) U.S. Cl. ..... 112/470.04
(58) Field of Search ..... 112/470.04, 470.01, 112/254, 470.06, 102.5

(56) References Cited

U.S. PATENT DOCUMENTS 4,616,583 A * 10/1986 Takano et al. ..... 112/470.04
4,784,073 A * 11/1988 Hanyu et al. ..... 112/453
6,173,665 B1 * 1/2001 Sekine ..... 112/102.5

* cited by examiner

*Primary Examiner*—Peter Nerbun
(74) *Attorney, Agent, or Firm*—Merchant & Gould, P.C.

(57) ABSTRACT

A sewing machine 100 comprises a nonvolatile memory 43, and it is possible to select two kinds of set modes including a normal mode and an initial set value changing mode when starting up the sewing machine 100. The initial set value changing mode is selected in regulation or maintenance after the assembly of the sewing machine 100. In the initial set value changing mode, a set value for a sewing work stored in a ROM 42 is exactly maintained or is properly changed, and is thus stored in the nonvolatile memory 43. Consequently, the set value for the sewing work is optimized depending on the sewing machine 100 which is mass-produced. The normal mode is selected in a normal sewing work. In the normal mode, the set value stored in the nonvolatile memory 43 is properly changed depending on each sewing work and is thus stored in a RAM 44.

3 Claims, 8 Drawing Sheets

SEWING MACHINE HAVING A MEANS FOR SETTING A SEWING WORKING DEVICE TO A PREDETERMINED OPTIMUM SET VALUE

BACKGROUND OF THE INVENTION

1. Field of the Invention

The present invention relates to a sewing machine comprising a device for changing a set value.

2. Description of the Related Art

In a sewing machine capable of selecting stitch types and patterns, a sewing operator manually changes a thread tension and then carries out sewing according to the selected sewing type and pattern. These set values are determined based on various experiments and tests which are repeated in the development stage of the sewing machine, and are generally stored as initial set values in an ROM (Read Only Memory) incorporated in the control means of the sewing machine, and are properly read in a control circuit during a sewing work and are displayed on a display section.

However, the initial set value which is optimum in the stage of tests and experiments is not always set in an optimum state depending on an assembly condition or a variation in sewing machines which are mass-produced.

More specifically, it is necessary to properly change an assembling method and components in order to reduce a manufacturing cost and eliminate drawbacks, thereby actually mass-producing a sewing machine developed through the stage of tests and experiments. For this reason, a difference in a shape and a dimension is made between a sewing machine produced by trial in the stage of tests and experiments and a mass-produced sewing machine. Moreover, each of the components of the sewing machine to be mass-produced is generally manufactured with some errors. The sewing machines assembled by using such components make different cumulative errors from each other.

Moreover, the initial set value is stored in an unrewritable ROM. Therefore, it is impossible to rewrite the initial set value of a sewing machine which is once assembled.

In order to manufacture, in a stage of mass-production, a sewing machine set to carry out sewing on a level realized in the stage of tests and experiments, for example, it is possible to propose a method of constructing a procedure for selecting and assembling components or adjusting a shape and an assembly after the completion of the assembly such that a difference in a shape is not made between a sewing machine produced by trial and a mass-produced sewing machine when optimizing the initial set value, thereby removing the difference. Moreover, it is also possible to propose a method of fabricating an ROM storing a set value optimized for each sewing machine assembled by the mass-production and to incorporate the ROM in the sewing machine.

However, there is a problem in that a great deal of cost and man-day (time) is required for all the methods described above.

SUMMARY OF THE INVENTION

In order to solve the problem, it is an object of the invention to easily and inexpensively carry out a work for changing, into an optimum set value, a set value of a mass-produced sewing machine which is not always set in an optimum state due to an assembly condition or a variation.

In order to solve the problem, a first aspect of the invention is directed to a sewing machine capable of setting working means for sewing to have a predetermined set value by electrical means and capable of selecting plural types of stitches, comprising:

- a first unrewritable storage section for storing an initial set value of the working means for each of the stitch types;
- a second rewritable nonvolatile storage section for storing, as a regulated set value, the initial set value read from the first storage section;
- a third rewritable storage section for storing, as a driving set value, the regulated set value read from the second storage section;
- set mode selecting means for selecting an initial value changing mode for changing a part or all of the initial set values read from the first storage section and storing them as the regulated set values in the second storage section and a normal mode for changing a part or all of the regulated set values read from the second storage section and storing them as the driving set values in the third storage section; and
- display means capable of displaying the regulated set value and the driving set value.

According to the first aspect of the invention, the initial set value stored in the first storage section is changed and is then stored as the regulated set value in the second rewritable nonvolatile storage means in the initial value changing mode, while the regulated set value read from the second storage section is changed and stored as the driving set value in the third storage section in the normal mode. Since the second storage section is thus provided, the initial set value which is preset can easily be set to be an optimum value corresponding to the stitch type depending on each sewing machine. Moreover, the predetermined data of the second storage section and the third storage section are displayed on the display device so that a work for changing a set value and a regulating work based on stitch data can easily be carried out. The predetermined data indicate optimized initial values and upper and lower limit values to be set in relation to a procedure for a stitch which is set to each stitch, a thread tension, a knife width and a ratio of feed to differential feed. Accordingly, it is possible to easily and inexpensively fabricate a sewing machine capable of carrying out a sewing work with a high strength and an excellent appearance.

In addition, the regulated set value stored in the second storage section can be rewritten. Therefore, the regulated set value is caused to be rewritable in the maintenance of the sewing machine so that the maintenance and management of the sewing machine can be carried out easily and inexpensively.

Moreover, a second aspect of the invention is directed to a sewing machine capable of setting working means for sewing to have a predetermined set value by electrical means and capable of selecting plural types of stitches, comprising:

- a first unrewritable storage section for storing an initial set value of the working means for each of the stitch types;
- a second rewritable nonvolatile storage section for storing, as a regulated set value, the initial set value read from the first storage section;
- a third rewritable storage section for storing, as a driving set value, the regulated set value read from the second storage section;
- initial value changing means for changing a part or all of the initial set values read from the first storage section and storing them as the regulated set values in the second storage section;
- normal setting means for changing a part or all of the regulated set values read from the second storage section and storing them as the driving set values in the third storage section; and display means capable of displaying the regulated set value and the driving set value.

According to the second aspect of the invention, the initial set value stored in the first storage section is changed and is then stored as the regulated set value in the second rewritable nonvolatile storage means by the initial value changing means, while the regulated set value read from the second storage section is changed and stored as the driving set value in the third storage section by the normal setting means. Since the second storage section is thus provided, the initial set value which is preset can easily be set to be an optimum value corresponding to the stitch type depending on each sewing machine. Moreover, the predetermined data of the second storage section and the third storage section are displayed on the display device so that a work for changing a set value and a regulating work based on stitch data can easily be carried out. In addition, the regulated set value stored in the second storage section can be rewritten. Therefore, the regulated set value is caused to be rewritable in the maintenance of the sewing machine so that the maintenance and management of the sewing machine can be carried out easily and inexpensively.

A third aspect of the invention is directed to a sewing machine capable of setting working means for sewing to have a predetermined set value by electrical means and capable of selecting plural types of stitches, comprising:

an ROM (Read Only Memory) for storing an initial set value which is previously optimized as the set value of the working means in a stage of tests;

a rewritable nonvolatile memory for storing, as a regulated set value, the initial set value read from the ROM;

an RAM (Random Access Memory) for storing, as a driving set value, the regulated set value read from the nonvolatile memory;

initial value changing means for changing a part or all of the initial set values read from the ROM and storing them as the regulated set values in the nonvolatile memory;

normal means for changing a part or all of the regulated set values read from the nonvolatile memory and storing them as the driving set values in the RAM; and display means capable of displaying set value data in the nonvolatile memory and the RAM.

In the manufacture and maintenance of the sewing machine, consequently, the initial set value can be optimized again depending on the assembled sewing machine and can be stored as the regulated set value in the nonvolatile memory, and the regulated set value can be properly changed to be optimum when the sewing work is to be carried out by using the sewing machine, and can be stored as the driving set value in the RAM. Thus, the initial set value determined in the stage of tests and experiments can easily be optimized again depending on each of the sewing machines which are assembled by mass-production. Moreover, the set value data of the nonvolatile memory and the RAM can be displayed. Therefore, it is possible to easily carry out a work for changing a set value and a regulating work based on stitch data.

DESCRIPTION OF THE PREFERRED EMBODIMENTS

The invention will be described below with reference to the drawings by taking, as an example, an overlock sewing machine 10 for carrying out a sewing work for forming an over-edge chain stitch, a double chain stitch and a covering chain stitch. The invention can be applied to sewing machines having other uses and shapes in addition to the overlock sewing machine.

Figure 1:
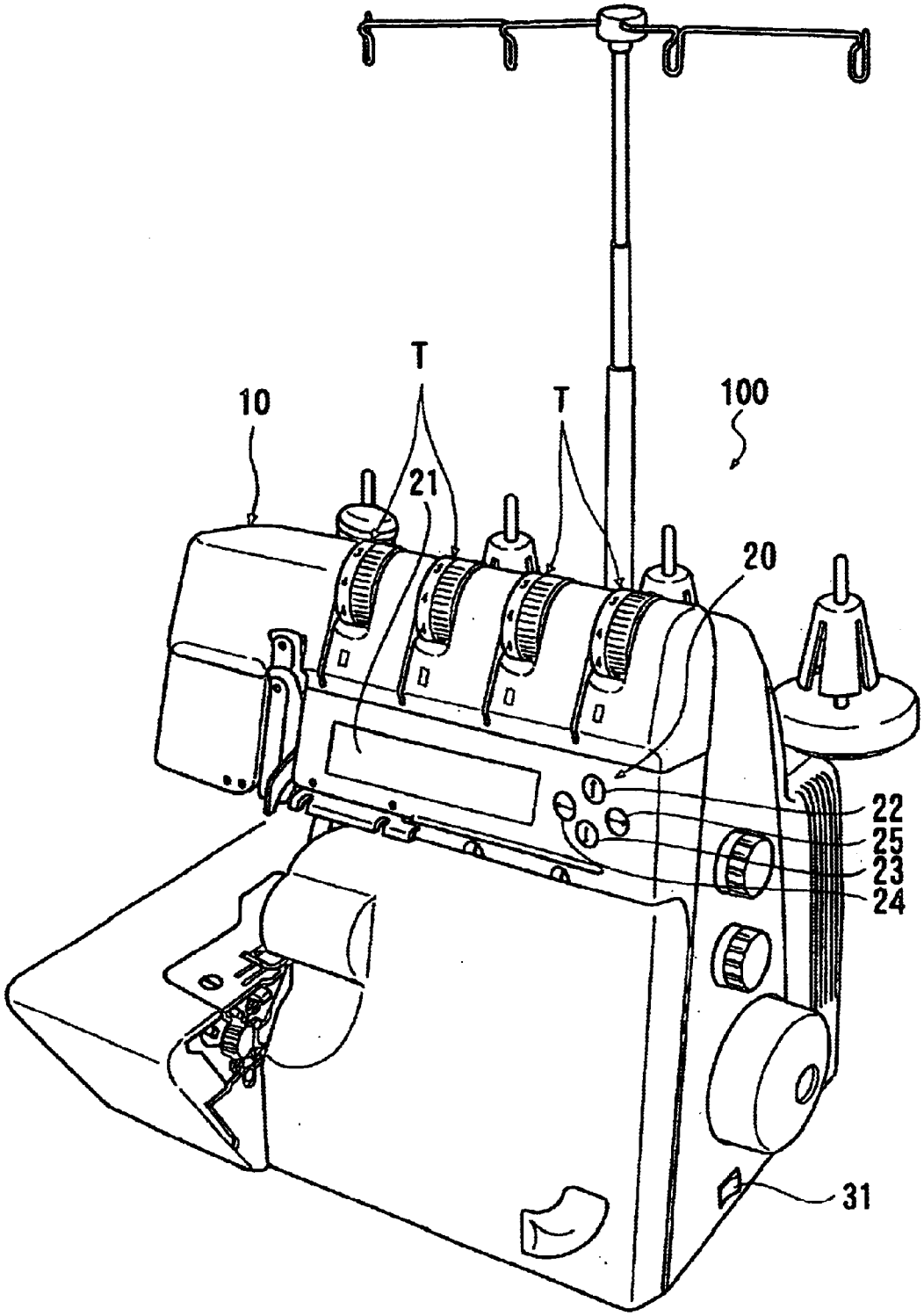
FIG. 1 is a perspective view showing the appearance of a sewing machine 100 according to the invention.
Figure 2:
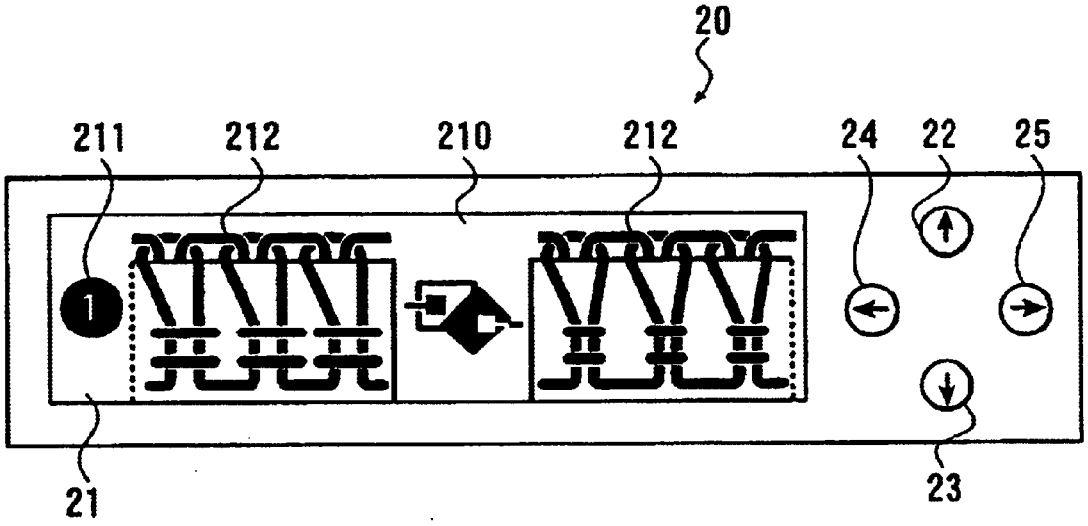
FIG. 2 is a front view showing display operating means 20 to be applied to the sewing machine 100 according to the invention.
Figure 3:
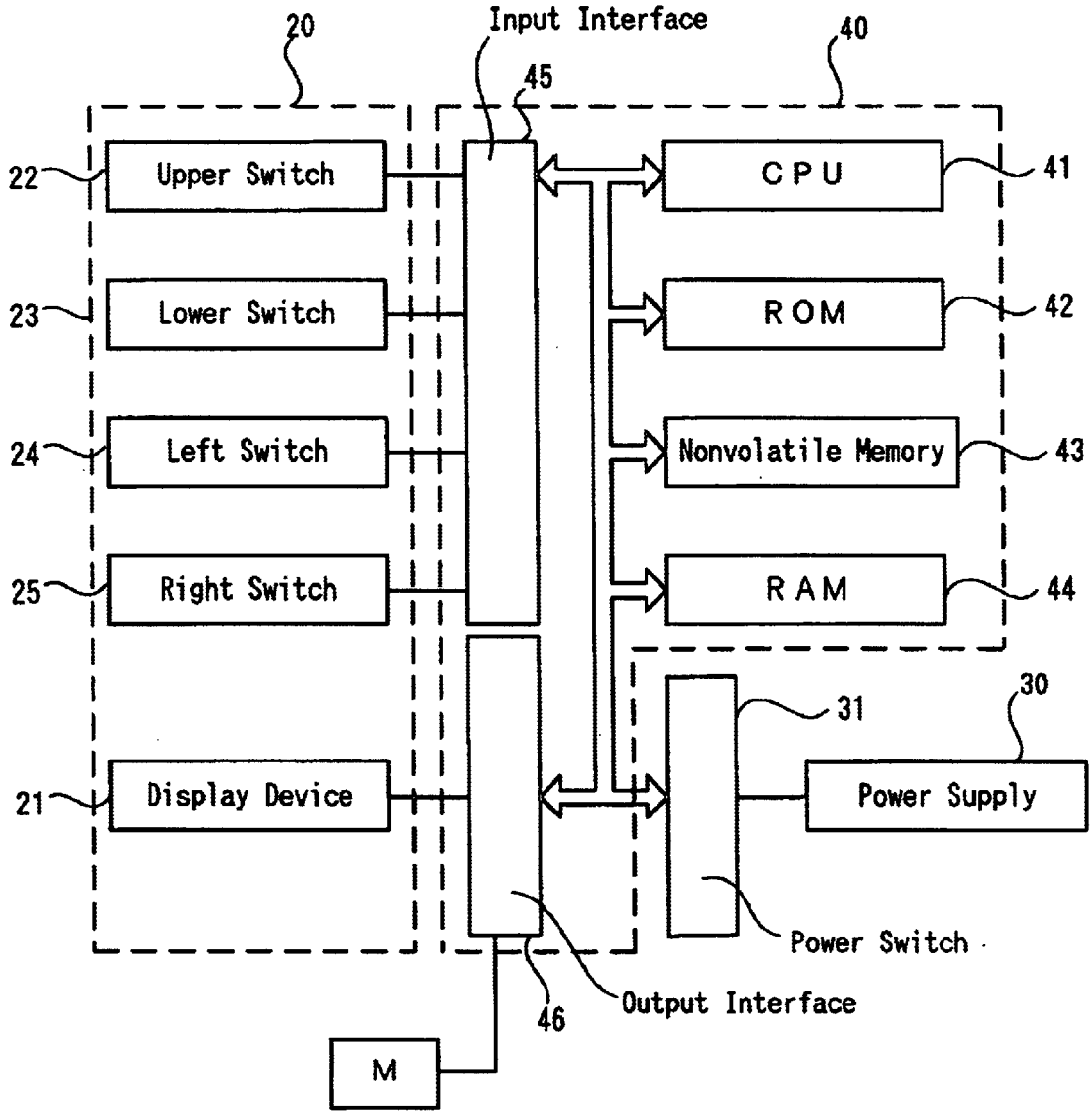
FIG. 3 is a block diagram showing the main part of the structure of the sewing machine 100.

In FIGS. 1 to 3, the sewing machine 100 comprises a body frame 10, display operating means 20, a power supply 30, control means 40 and stitch forming means such as a needle and a looper which are not shown. The needles and loopers provided in proper numbers (not shown) are driven by a driving motor (not shown) and are operated interlockingly with each other, and receive the supply of a thread through a thread tensioner T, thereby forming a stitch on a cloth. In the thread tensioner T, moreover, a thread tension is regulated by thread tension driving means M such as a pulse motor.

The display operating means 20 is a device for changing a set value of the thread tension, and is provided in the front part of the body frame 10. The display operating means 20 includes an upper switch 22, a lower switch 23, a left switch 24 and a right switch 25. The upper switch 22, the lower switch 23, the left switch 24 and the right switch 25 are push button switches, for example, and are used for an input operation in a sewing work or a set value changing work which will be described below.

A display device 21 to be the display means is a liquid crystal panel, for example, and displays information related to the sewing work of the sewing machine 100. The display device 21 can display the contents of display based on the predetermined data of a second storage section (a nonvolatile memory 43) and a third storage section (an RAM 44) which will be described below. The predetermined data indicate data such as a sewing procedure for each sewing shape and sewing type which are set every stitch type or numerical data such as initial values optimized for a thread tension of a needle thread or a looper thread, a knife width to be a spacing between a cloth and a knife location and a ratio of feed to differential feed, and upper and lower limit values to be set.

In FIG. 3, the power supply 30 to be a commercial power supply feeds or cuts off a power for driving and controlling each portion of the sewing machine 100 by means of a power switch 31.

The control means 40 includes a CPU (Central Processing Unit) 41, an ROM (Read Only Memory) 42, a nonvolatile memory 43, an RAM (Random Access Memory) 44, an input interface 45 and an output interface 46.

The CPU 41 carries out various calculations and decisions based on data stored in the ROM 42, the nonvolatile memory 43 and the RAM 44 or data transmitted from the display operating means 20 which are input through the input interface 45, and controls each component of the sewing machine 100.

The ROM 42 (first storage section) stores data on initial set values optimized in the stage of tests and experiments for each stitch in relation to a sewing procedure which can be carried out by the sewing machine 100, each thread tension, a knife width, and a ratio (an operation ratio) of feed to differential feed, and data on upper and lower limit values for changing the initial set values and a regulated set value which will be described below.

The nonvolatile memory 43 (second storage section) is constituted by a magnetic disk, for example, and can hold the stored data even if the power supply of the sewing machine 100 is turned OFF, and can rewrite the stored data at any time. The nonvolatile memory 43 stores the initial set value read from the ROM 42 and the regulated set value which is properly rewritten. A storage capacity to be given to the nonvolatile memory 43 is properly determined by setting an amount for storing all the set values to be a minimum.

The RAM 44 (third storage section) is properly divided into a storage area for storing, as a driving set value, a set value which is read from the ROM 42 or the nonvolatile memory 43 or is regulated, and a work area in which data for a sewing work and a set value changing work to be described below are stored.

The input interface 45 is connected to input devices such as the upper switch 22, the lower switch 23, the left switch 24 and the right switch 25, and mediates these input devices and the components such as the CPU 41 and the RAM 44. The output interface 46 is connected to output devices such as the display device 21 and a driving circuit which is not shown, and mediates these output devices and the components such as the CPU 41 and the RAM 44.

The thread tensioner T (thread tension driving means M) and the driving motor are connected to the control means 40 through a driving circuit which is not shown, respectively, and are controlled by the control means 40.

By turning ON the power supply, a set mode which will be described below is selected. In the embodiment, the lower switch 23 and the power switch 31 are combined and used as means for selecting the set mode. The set mode selecting means is constituted by the lower switch 23 and the power switch 31.

Next, a procedure for changing a set value in the sewing machine 100 will be described below with reference to the drawings.

The set mode selected by the set mode selecting means has two kinds of modes including an initial value changing mode and a normal mode, for example, and one of the set modes is always selected when starting up the sewing machine 100. For example, when only the power switch 31 is turned ON, the normal mode is selected and set. When the power switch 31 is turned ON with the lower switch 23 pressed, the initial value changing mode is selected and set.

In the initial value changing mode, the initial set values optimized and determined previously for each stitch, for example, a thread tension of a needle thread or upper and lower looper threads, a knife width and a ratio of feed to differential feed in the data stored in the ROM 42 are exactly stored as regulated set values in the nonvolatile memory 43, or a part or all of them are rewritten and stored as regulated set values in the nonvolatile memory 43. The initial value changing mode is selected and used after the assembly of the sewing machine 100, during regulation before shipment or at time of maintenance and repair of the sewing machine 100.

In the normal mode, the regulated set values stored in the nonvolatile memory 43 as described above are exactly stored as driving set values in the RAM 44, or a part or all of them are rewritten and stored as the driving set values in the RAM 44.

Figure 4:
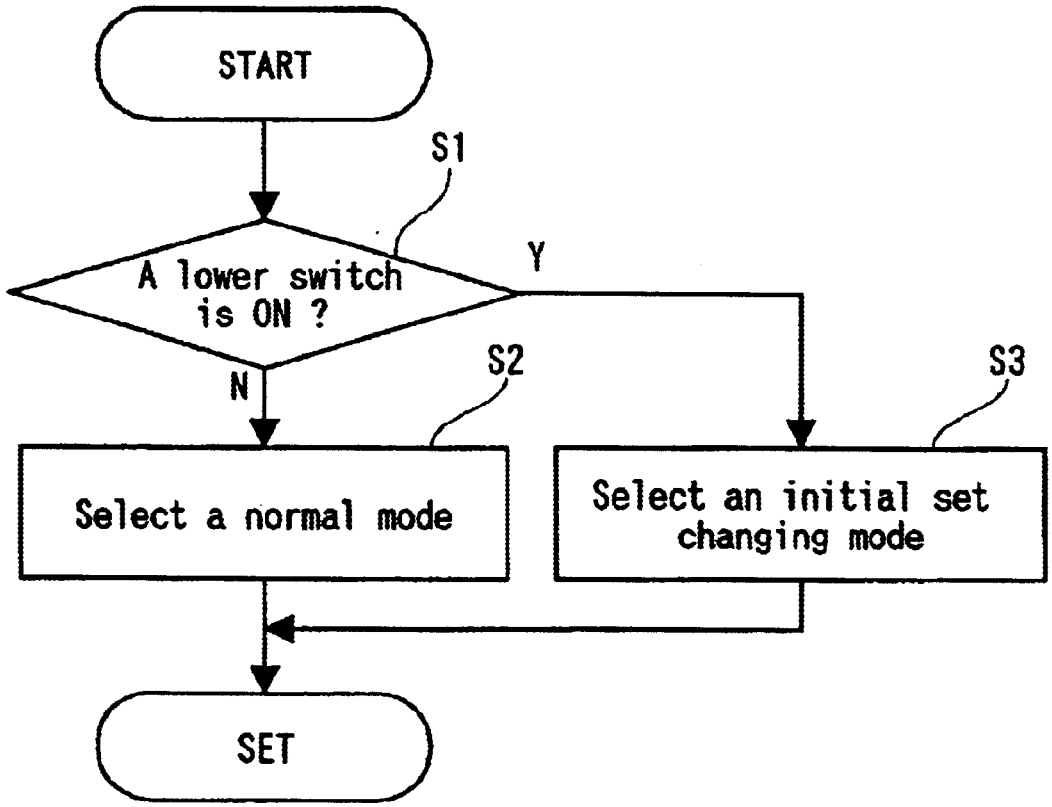
FIG. 4 is a flowchart showing a procedure for selecting a set mode in the sewing machine 100.

The selection of the initial value changing mode and the normal mode is carried out by the operation of the set mode selecting means. As shown in a flowchart of FIG. 4, when the sewing machine 100 is started up, it is decided whether the lower switch 23 is ON or not (S1). Based on the decision, the selection is carried out. More specifically, when the power switch 31 is turned ON, the normal mode is selected if the lower switch 23 is not pushed and is OFF (S2). On the other hand, in the case in which the lower switch 23 is pushed and is thus turned ON and the power switch 31 is turned ON, the initial value changing mode is selected (S3).

Figure 6A:
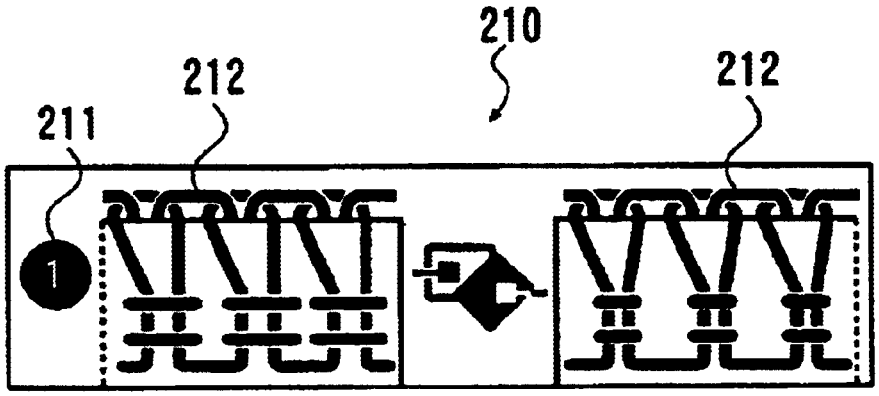
Figure 6B:
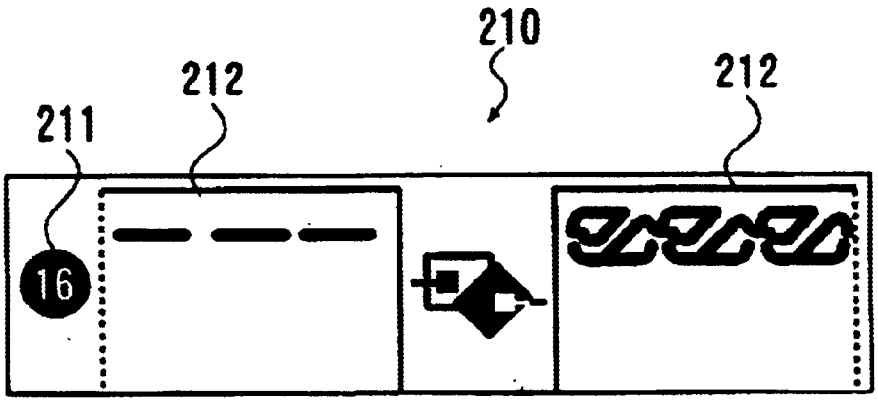

Subsequently, description will be given to a procedure for a set value changing work in the sewing machine 100. First of all, when the power switch 31 is turned ON, the initial value changing mode or the normal mode is selected and a stitch selection screen 210 shown in FIG. 6(*a*) and FIG. 6(*b*) is then displayed on the display device 21, for example.

Figure 5:
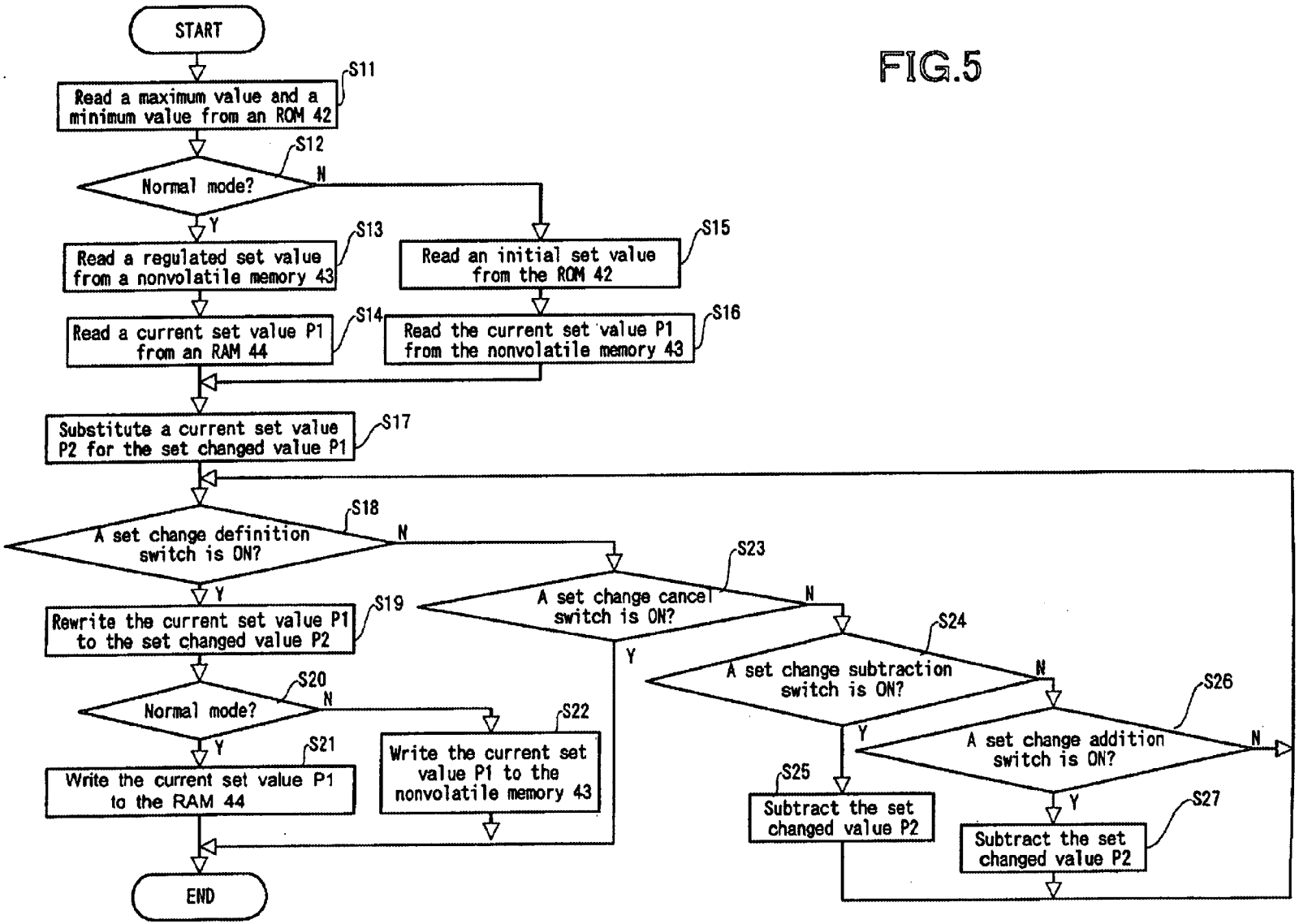
FIG. 5 is a flowchart showing a procedure for changing a set value in the sewing machine 100, FIGS. 6(*a*) and 6(*b*) show the views showing an example of a stitch selection screen 210 displayed on display control means 21, FIG. 6(*a*) being a schematic view showing the case of overcasting using two needles and four threads and FIG. 6(*b*) being a schematic view showing the case of double chain stitch separate sewing.

If an operation for changing a set value is not required at this time, the selecting operation is properly carried out to read the set value without executing a processing shown in FIG. 5, and a next work is started immediately after writing. More specifically, in the initial value changing mode, the initial set value is exactly written as the regulated set value in the nonvolatile memory 43 and a next work such as test driving is then started. In the normal mode, moreover, the regulated set value which has been set is exactly written as the driving set value in the RAM 44 and a next work such as sewing is then started.

In a state in which the stitch selection screen 210 is displayed on the display device 21, an operator for changing a set value carries out a stitch selecting operation to change a set value. The stitch selection screen 210 is constituted by a stitch number display 211 given to each stitch and a stitch shape display 212 schematically illustrating shapes on the surface and back of a cloth for the stitch corresponding to the number display 211, for example.

In a state in which the stitch selection screen 210 is displayed on the display device 21, the upper switch 22 functions as a stitch number down switch for decreasing the stitch number of a stitch which is displayed on the stitch selection screen 210. The lower switch 23 functions as a stitch number up switch for increasing the stitch number. The left switch 24 functions as a stitch number selection switch for selecting a stitch having a stitch number which is currently displayed on the display device 21. The operator pushes the upper switch 22 and the lower switch 23 at a proper number of times, thereby causing the display device 21 to display the stitch selection screen 210 corresponding to a stitch to change a set value, and then pushes the left switch 24, thereby determining a stitch.

Figure 7A:
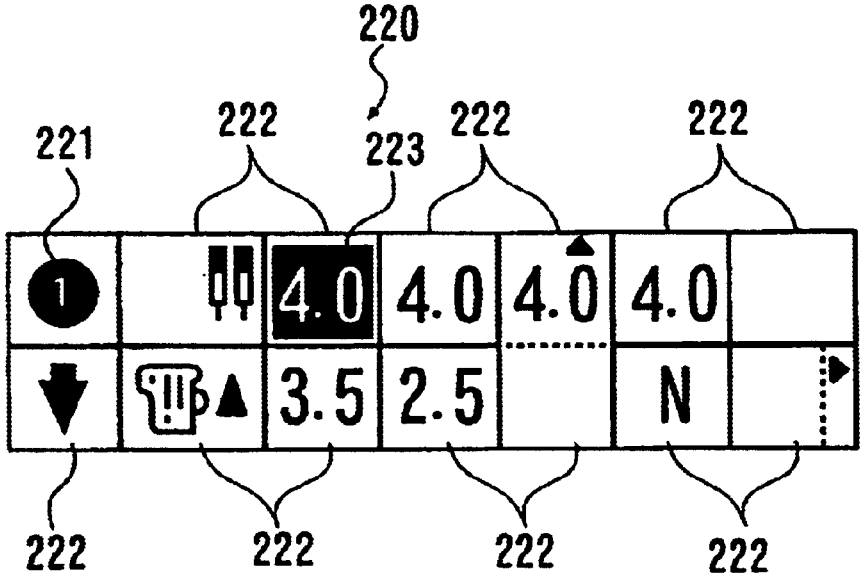
FIG. 7 is a view showing an example of a set value list screen 220 displayed on the display control means 21.
Figure 7B:
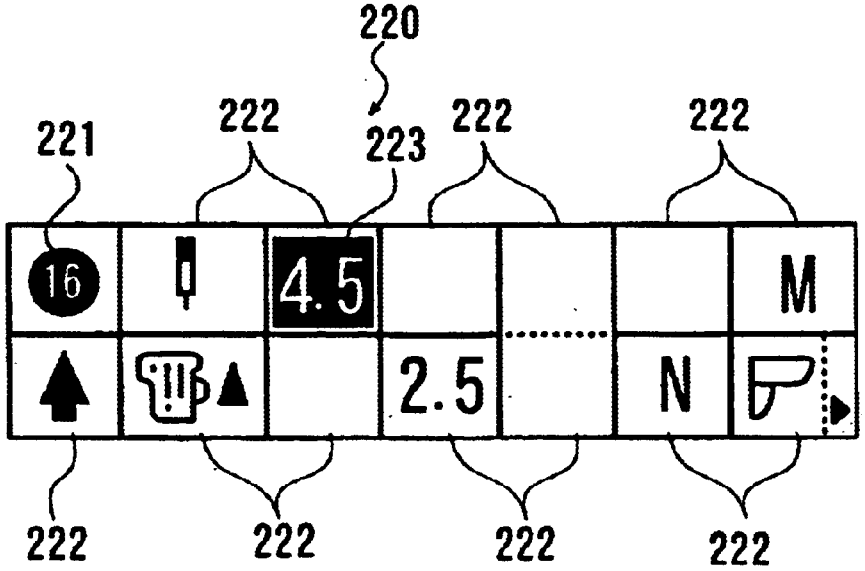

When the operator determines a stitch, the set value changing work proceeds to an operation for selecting the item of the set value to be changed, and the stitch selection screen 210 displayed on the display device 21 is rewritten to a set value list screen 220 shown in FIG. 7, for example.

The set value list screen 220 is constituted by a number display 221 and a set value display 222. The number display 221 shows the stitch number of a selected stitch. The set value displays 222, 222, . . . show, in numeric values or symbols, the set values of items, for example, a needle attachment position, a tension of a thread supplied to each needle and each looper, driving set or driving set cancellation of components such as a knife, a overlooking click or an upper looper, and a ratio of feed to differential feed. In the set value list screen 220, the selected item is displayed by a cursor 223, for example. Moreover, it is assumed that the items which are not related to the selected stitch are not displayed on the set value list screen 220.

In a state in which the set value list screen 220 is displayed on the display device 21, the right switch 25 functions as a change item selection switch for causing the operator to sequentially select the item of the set value to be changed from the items displayed by the set value displays 222, 222 . . . and the cursor 223 is moved over the set value list screen 220 by an operation. The items having numeric values fixed in the selected switch cannot be selected by the change item selection switch, and the cursor 223 jumps the set value display 222 of the set value and moves to the further adjacent set value display 222 when the right switch 25 is operated. Moreover, the left switch 24 functions as a change item determination switch for determining the item of a set value to be changed and proceeding to a set value changing operation. Furthermore, the upper switch 22 and the lower switch 23 function as change end switches for ending the set value changing work.

The operator pushes the right switch 25 at a proper number of times while visually observing a display position by the cursor 223 in the set value list screen 220, thereby selecting the item of the set value to be changed. After the item to be changed is selected, the operator pushes the left switch 24 to determine the item to be changed. By determining the item to be changed, an operation for changing the set value of the selected item is started and the set value list display 220 displayed on the display device 21 is rewritten to a set value change screen 230 shown in FIG. 8, for example, and a series of calculations and operations shown in a flowchart of FIG. 5 are started.

Figure 8:
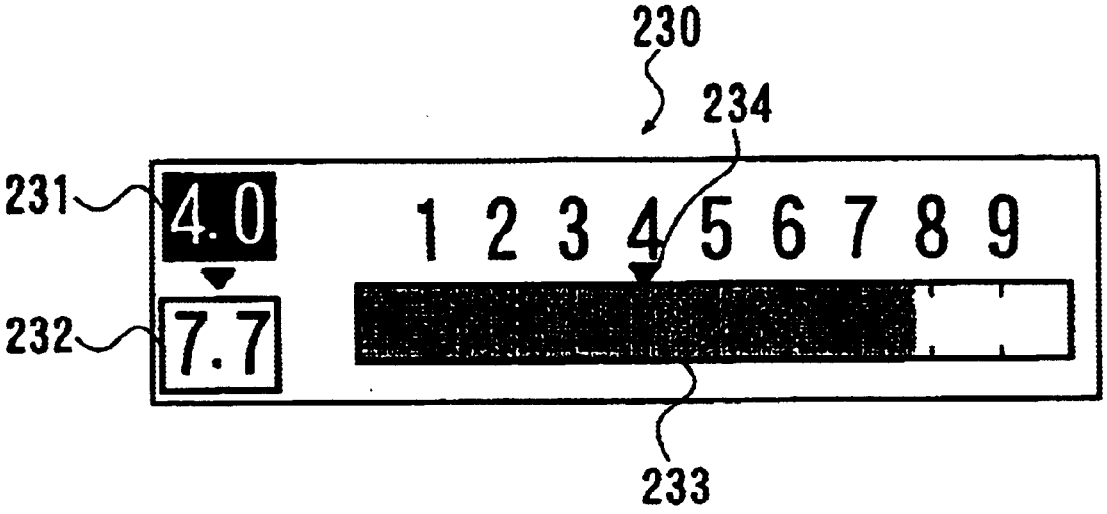
FIG. 8 is a view showing an example of a set value change screen 230 displayed on the display control means 21.

As an example, FIG. 8 shows the set value change screen 230 to be displayed in the case in which the tension set value of the thread tensioner T for a thread supplied to a needle or a looper is to be changed. The set value change screen 230 for changing the set value of the thread tension is constituted by a current set value display 231, a change set value display 232, a bar graph 233 and an initial set value mark 234. The current set value display 231 indicates a numeric value corresponding to a set value P1 obtained before a changing operation. The change set value display 232 indicates a changed set value P2 which is obtained by the operation. The bar graph 233 illustrates the relationship between the changed set value P2 and the maximum and minimum values of the set value. The initial set value mark 234 is a triangular mark, for example, and a value corresponding to the initial set value (initial value changing mode) stored in the ROM 42 or the regulated set value (normal mode) stored in the nonvolatile memory 43 as will be described below is superposed on the bar graph 233 and is thus displayed.

In a state in which the set value change screen 230 is displayed on the display device 21, the right switch 25 functions as a set value addition switch for increasing the changed set value P2. The left switch 24 functions as a set value subtraction switch for decreasing the changed set value P2. The lower switch 23 functions as a set change cancel switch for invalidating the changing operation for the changed set value P2 which is carried out by the operations of the right switch 25 and the left switch 24. The upper switch 22 functions as a set change definition switch for defining the changed set value P2 changed by the increasing/decreasing operation by the operations of the right switch 25 and the left switch 24.

A procedure for the set value changing operation will be described with reference to the flowchart of FIG. 5. First of all, maximum and minimum values for determining the range of a set value to be changed are read in a stitch selected and determined as described above from the ROM 42, and are stored in the work area of the RAM 44 (S11). Subsequently, a selected set mode is decided (S12).

In the case in which the normal mode is selected when the power supply is ON, a regulated set value corresponding to the selected stitch in the data stored in the nonvolatile memory 43 is read and the display position of the initial set value mark 234 is set (S13). Furthermore, the driving set value stored in the storage area of the RAM 44 is read as the current set value P1 (S14), and the current set value P1 is stored as the changed set value P2 in the work area of the RAM 44 (S17).

On the other hand, in the case in which the initial value changing mode is selected when the power supply is ON, an initial set value corresponding to the selected stitch in the data stored in the ROM 42 is read and the display position of the initial set value mark 234 is set (S15). Furthermore, the regulated set value stored in the nonvolatile memory 43 is read as the current set value P1 (S16), and is stored as the changed set value P2 in the work area of the RAM 44 (S17).

After the S17, a processing of changing a set value progresses by the same operation and calculation in both of the normal and initial value changing modes until a processing of rewriting the current set value P1 (S19).

In a state in which the upper switch 22 to be the set change definition switch and the lower switch 23 to be the set change cancel switch are not pushed, the processing of changing a set value proceeds to S24. In the case in which the selected set value is to be decreased to be smaller than the current set value P1, the left switch 24 to be the set value subtraction switch is pushed to subtract the changed set value P2 (S24, S25). Moreover, in the case in which the selected set value is to be increased to be greater than the current set value P1, the right switch 25 to be the set value addition switch is pushed to add the changed set value P2 (S26, S27). In the case in which the set value is greater than the maximum value for determining the range of the set value to be changed or is smaller than the minimum value for determining the same range in the addition and subtraction, the addition and the subtraction are not carried out.

The operator pushes the right switch 25 and the left switch 24 at a proper number of times while visually referring to the display of the set value change screen 230, thereby carrying out a transition of the changed set value P2 to a desired numeric value.

In the case in which the changed set value P2 obtained by the transition in the above operation is to be invalidated, it is preferable that the lower switch 23 to be the set change cancel switch should be pushed to once end the set value changing operation (S23). At this time, the display of the display device 21 returns to the set value list screen 220 of a corresponding stitch. Therefore, the operator selects a set value again to restart the set value changing operation at the S11.

Moreover, in the case in which the set value is defined by the numeric value of the changed set value P2 obtained by the transition in the above operation, the upper switch 22 to be the set change definition switch is pushed to end the set value changing operation (S18). At this time, the current set value P1 stored in the work area of the RAM 44 is rewritten to a numeric value which is equal to the changed set value P2 obtained by the transition (S19).

The set mode is decided again (S20). If the set mode is the normal mode, the driving set value stored in the storage area of the RAM 44 is rewritten to the current set value P1 rewritten and stored by the above operation in the work area of the RAM 44 (S21). On the other hand, if the set mode is the initial value changing mode, the regulated set value stored in the nonvolatile memory 43 is rewritten to the current set value P1 rewritten and stored in the work area of the RAM 44 (S22).

Thus, the regulated set value stored in the nonvolatile memory 43 is rewritten in the initial value changing mode or the driving set value stored in the RAM 44 is rewritten in the normal mode so that the operation for changing one set value is completed. Subsequently, the above changing operation is carried out for all the items to change the set values. After all the changing operations are ended, a next work such as a sewing work is started or the power switch 31 is turned OFF.

In the operation for changing a set value, the relationship between the numeric value of the set value displayed on the display device and a numeric value such as a physical quantity which is actually set is properly determined in consideration of an operability based on data on experiments and tests.

Moreover, in the case in which the set value is to be changed for items such as the position of a needle and driving/cancellation of each component in addition to the items noted in a numeric value such as a thread tension, for example, an identification number is attached to a configuration which can be selected for each stitch and set value and a design is carried out by reading the identification number into the numeric value of the set value so that the set value can be changed by the same operation as described above.

Furthermore, the screen to be displayed on the display device 21, the switch to be handled in the individual operations described above and the contents of a calculation in the operation of the switch are design matters and are properly determined in consideration of an operability and a safety in the sewing work.

Next, description will be given to the regulating work of the sewing machine 100 and the sewing work using the sewing machine 100. Usually, some difference in a shape between the mass-produced sewing machine 100 and a sewing machine having the same shape which is manufactured by trial in the stage of development is made due to a cumulative error generated by a variation in an assembling method or by the error of components constituting the sewing machine 100. For this reason, the initial set value optimized and stored in the ROM 402 in the sewing machine manufactured by trial is not optimum for each of the mass-produced sewing machines 100 in some cases. In order to optimize a set value related to the sewing work in the mass-produced sewing machine 100, accordingly, each of the sewing machines 100 is assembled and the regulating work is then carried out before shipment. Thus, the set value can further be optimized.

In the regulating work, first of all, the assembled sewing machine 100 is started up in the initial value changing mode and test driving is carried out in a state in which the initial set value is exactly stored as a regulated set value in the nonvolatile memory 43. As a result of the test driving, in the case in which a finished stitch formed by the sewing machine 100 has a different level than that of a finished stitch formed by the sewing machine 100 manufactured by trial, the regulated set value is rewritten and optimized such that both of the finished stitches have the same level based on a difference in the finishing condition. The regulated set value thus optimized is stored in the nonvolatile memory 43 also after the power supply of the sewing machine 100 is reduced. Thus, the sewing machine 100 is shipped with the regulated set value stored in the nonvolatile memory 43.

When the sewing work is to be carried out in the sewing machine 100, the sewing machine 100 is first started up in a normal mode and the work is then started. At this time, the regulated set value which is optimized in the regulating work is read from the nonvolatile memory 43 and is stored as a driving set value in the RAM 44, and is applied to the driving operation of the sewing machine 100. Every time the set value is to be changed corresponding to individual sewing works, the current set value P1 stored in the RAM 44 is rewritten by the operation for changing a set value. A set value thus obtained is consecutively applied to the driving operation of the sewing machine 100.

In the sewing work, the regulated set value stored in the nonvolatile memory 43 is not changed. Accordingly, when the sewing operator starts up the sewing machine 100 again, the regulated set value as the last value is read from the nonvolatile memory 43 and is applied to the driving operation of the sewing machine 100.

In some cases in which the sewing machine 100 has been used for years so that the shape of the sewing machine 100 is finely different from that in an assembly or components are exchanged, a set value optimized and stored in the nonvolatile memory 43 in the assembly of the sewing machine 100 is not optimum at the present time, resulting in a deterioration in a finished stitch. In these cases, the set value is properly changed in the initial value changing mode as a part of the maintenance and repair works for the sewing machine 100. Consequently, sewing can be carried out again with a finished stitch having the same level as that in the assembly.

Thus, the sewing machine 100 comprises the nonvolatile memory 43 and the data read from the ROM 42 are changed and are then stored in the nonvolatile memory 43 in the initial value changing mode. Consequently, it is possible to easily change and optimize a set value required for a sewing work depending on each of the sewing machines 100 which are mass-produced.

As compared with the case in which components are generally selected and assembled such that a set value obtained by a sewing machine manufactured by trial can be exactly applied or an ROM storing an optimum set value is fabricated for each of the sewing machines which are mass produced, therefore, it is possible to more easily and inexpensively fabricate the sewing machine 100 capable of carrying out a sewing work with a stitch having a high strength and an excellent appearance at the same level as that implemented in the sewing machine manufactured by trial.

In addition, the regulated set value stored in the nonvolatile memory 43 can be changed by selecting the initial value changing mode at time of start-up also in the maintenance of the sewing machine 100. Thus, the set value required for the sewing work can be properly changed so that the maintenance and management of the sewing machine 100 can also be carried out easily and inexpensively. Moreover, the predetermined data of the first storage section (the ROM 42), the second storage section (the nonvolatile memory 43) and the third storage section (the RAM 44) are displayed on the display device 21. Consequently, it is possible to easily carry out a set value changing work and a regulating work based on stitch data.

The sewing machine 100 according to the invention is not restricted to the lock sewing machine according to the embodiment. The invention can be applied to sewing machines having every use and shape.

The third storage section to be applied to the sewing machine 100 according to the invention is not restricted to the RAM 44. Any rewritable storage device can be applied to the third storage section, and the nonvolatile memory 43 may serve as the second storage section and the third storage section, for example.

The set mode selecting means to be applied to the sewing machine 100 according to the invention is not restricted to a combination of the power switch 31 and the lower switch 23 described above. For example, a switch which is not handled in a normal sewing work may be separately provided as the set mode selecting means or the switch provided separately and the switch to be handled in the normal sewing work may be properly combined to form the set mode selecting means.

Moreover, the set value may be changed in the initial value changing mode by means of the switch provided on the display operating means 20, and furthermore, by connecting an external input device such as a personal computer or a jig device to the sewing machine 100. In this case, the operation for changing a set value can be carried out rapidly.

According to the invention, a sewing machine capable of carrying out a sewing work with a high strength and an excellent appearance can be fabricated easily and inexpensively.

What is claimed is:

1. A sewing machine capable of setting working means for sewing to have a predetermined set value by electrical means and capable of selecting plural types of stitches, comprising:

a first storage section, functioning as an unrewritable storage memory, for storing an initial set value of the working means for each of the stitch types;

a second storage section, functioning as a rewritable-nonvolatile memory for storing, as a regulated set value, the initial set value read from the first storage section;

a third storage section, functioning as a rewritable memory, for storing the regulated set value read from the second storage section as a driving set value;

set mode selecting means for selecting an initial value changing mode for changing a part or all of the initial set values read from the first storage section and storing them as the regulated set values in the second storage section and a normal mode for changing a part or all of the regulated set values read from the second storage section and storing them as the driving set values in the third storage section; and display means capable of displaying the regulated set value and the driving set value.

2. A sewing machine capable of setting working means for sewing to have a predetermined set value by electrical means and capable of selecting plural types of stitches, comprising:

a first storage section, functioning as an unrewritable storage memory, for storing an initial set value of the working means for each of the stitch types;

a second storage section, functioning as a rewritable-nonvolatile memoty, for storing, as a regulated set value, the initial set value read from the first storage section;

a third storage section, functioning as a rewritable memory, for storing the regulated set value read from the second storage section as a driving set value;

initial value changing means for changing a part or all of the initial set values read from the first storage section and storing them as the regulated set values in the second storage section;

normal setting means for changing a part or all of the regulated set values read from the second storage section and storing them as the driving set values in the third storage section; and display means capable of displaying the regulated set value and the driving set value.

3. A sewing machine capable of setting working means for sewing to have a predetermined set value by electrical means and capable of selecting plural types of stitches, comprising:

a ROM (Read Only Memory) for storing an initial set value which is previously optimized as the set value of the working means in a stage of tests;

a rewritable nonvolatile memory for storing, as a regulated set value, the initial set value read from the ROM;

a RAM (Random Access Memory) for storing, as a driving set value, the regulated set value read from the nonvolatile memory;

initial value changing means for changing a part or all of the initial set values read from the ROM and storing them as the regulated set values in the nonvolatile memory;

normal means for changing a part or all of the regulated set values read from the nonvolatile memory and storing them as the driving set values in the RAM; and display means capable of displaying set value data in the nonvolatile memory and the RAM.

* * * * *